United States Patent [19]

Fujimoto et al.

[11] Patent Number: 4,928,228

[45] Date of Patent: May 22, 1990

[54] APPARATUS FOR DETECTING MISFIRE AND FOR CONTROLLING FUEL INJECTION

[75] Inventors: Takanori Fujimoto; Toshiro Hara, both of Himeji, Japan

[73] Assignee: Mitsubishi Denki Kabushiki Kaisha, Tokyo, Japan

[21] Appl. No.: 196,427

[22] Filed: May 20, 1988

[30] Foreign Application Priority Data

| | | | |
|---|---|---|---|
| May 26, 1987 | [JP] | Japan | 62-130220 |
| May 26, 1987 | [JP] | Japan | 62-130219 |
| May 26, 1987 | [JP] | Japan | 62-130218 |
| May 26, 1987 | [JP] | Japan | 62-130217 |
| May 26, 1987 | [JP] | Japan | 62-130216 |

[51] Int. Cl.[5] ..... F02M 51/00; F02P 17/00; F02P 11/06

[52] U.S. Cl. ..... 364/431.09; 73/117.3; 123/479; 364/431.05

[58] Field of Search ..... 364/431.09, 431.08; 123/479, 487; 73/117.3

[56] References Cited

U.S. PATENT DOCUMENTS

| | | | |
|---|---|---|---|
| 3,938,075 | 2/1976 | Reddy | 123/479 |
| 3,948,228 | 4/1976 | Luchaco | 123/479 |
| 4,006,718 | 2/1977 | Konomi | 123/479 |
| 4,366,794 | 1/1983 | Hachiga et al. | 123/479 |
| 4,372,269 | 2/1983 | Coles | 123/487 |
| 4,558,417 | 12/1985 | Akiyama et al. | 364/431.05 |
| 4,561,056 | 12/1985 | Hirayama et al. | 364/431.05 |
| 4,567,755 | 2/1986 | Ootsuka et al. | 73/117.3 |
| 4,626,997 | 12/1986 | Takeda et al. | 364/431.05 |
| 4,710,881 | 12/1987 | Mouri et al. | 364/431.08 |
| 4,727,841 | 3/1988 | Hirose et al. | 364/431.05 |

FOREIGN PATENT DOCUMENTS

| | | | |
|---|---|---|---|
| 2528785 | 2/1976 | Fed. Rep. of Germany . | |
| 3208587 | 9/1983 | Fed. Rep. of Germany . | |
| 58-117326 | 7/1983 | Japan | 123/479 |

*Primary Examiner*—Felix D. Gruber

*Attorney, Agent, or Firm*—Oblon, Spivak, McClelland, Maier & Neustadt

[57] ABSTRACT

An engine control apparatus which is constructed with a cylinder discrimination sensor for generating cylinder discrimination signal, a crank angle sensor for generating crank angle signal, a fuel injection valve provided in each cylinder of the engine, an ignition coil provided in correspondence to each and every cylinder, a flip-flop which functions to reverse in synchronism with ignition timing, misfire detector for detecting the state of misfire in each cylinder, and an engine control section for controlling the fuel injection valve and the ignition coil in correspondence to each cylinder upon receipt of the cylinder discrimination signal and the crank angle signal and for closing the fuel injection valve of the misfired cylinder upon receipt of the misfire detection signal.

9 Claims, 9 Drawing Sheets

APPARATUS FOR DETECTING MISFIRE AND FOR CONTROLLING FUEL INJECTION

BACKGROUND OF THE INVENTION

1. FIELD OF THE INVENTION

This invention relates to an engine control apparatus and, more particularly, it is concerned with an engine control apparatus which is capable of detecting misfire in any of the engine cylinders, and preventing unburnt gas in the misfired cylinder from burning in the vicinity of the exhaust pipe to shorten the service life of a catalyst in the exhaust pipe. In this application, misfire is used in the sense of the absence of an ignition signal, which is the main cause of non-ignition.

2. DISCUSSION OF BACKGROUND

Some of the conventional engine control apparatus carry out their fuel injection control and the ignition control for each engine cylinder. In such engine control apparatus, a multi-point injection device is used for the fuel injection control, while a low-tension power distribution ignition device is used for the ignition control.

In the above-described conventional engine control apparatus, the engine operation can still be continued, even if misfire occurs in a particular engine cylinder. However, when unburnt gas is discharged from the misfired cylinder, it is burned in the vicinity of the exhaust pipe to heat even a catalyst filled in it. On account of this, not only the service life of the catalyst becomes shortened, but also there is apprehension such that fire could occur.

SUMMARY OF THE INVENTION

The present invention has therefore been made with a view to solving the points of problem as mentioned above, and aims at providing an improved engine control apparatus which is simple in construction and is capable of preventing damage to the catalyst as well as the occurrence of fire.

According to the present invention, in one aspect of it, there is provided an engine control apparatus which comprises, in combination: a cylinder discrimination sensor for generating cylinder discrimination signal; a crank angle sensor for generating crank angle signal; a fuel injection valve provided in each cylinder of the engine; an ignition coil provided in correspondence to each and every cylinder; a flip-flop which functions to reverse in synchronism with ignition timing; misfire detection means for detecting the absence of an ignition signal; and an engine control section for controlling said fuel injection valve and said ignition coil in correspondence to each cylinder upon receipt of the cylinder discrimination signal and the crank angle signal, and for closing the fuel injection valve of the misfired cylinder upon receipt of the misfire detection signal.

According to the present invention, in another aspect of it, there is provided an engine control apparatus which comprises in combination: a cylinder discrimination sensor for generating cylinder discrimination signal; a crank angle sensor for generating crank angle signal; a fuel injection valve provided in each cylinder of the engine; an ignition coil provided for each to each and every cylinder; misfire detection means which controls said fuel injection valve and said ignition coil in correspondence to each cylinder upon receipt of the cylinder discrimination signal and the crank angle signal, and which detects misfire due to the absence of an ignition signal in each cylinder upon receipt of an ignition control signal of said ignition coil; and an engine control section which stops operation of said fuel injection valve of the misfired cylinder upon receipt of said misfire detection signal.

The foregoing objects, other objects as well as specific construction and operation of the engine control apparatus according to the present invention will become more apparent and understandable from the following detailed description of several preferred embodiments thereof, when read in conjunction with the accompanying drawing.

BRIEF DESCRIPTION OF THE ACCOMPANYING DRAWING

DETAILED DESCRIPTION OF PREFERRED EMBODIMENTS

In the following, the present invention will be described in detail with reference to several preferred embodiments thereof as shown in the accompanying drawing.

Figure 1:
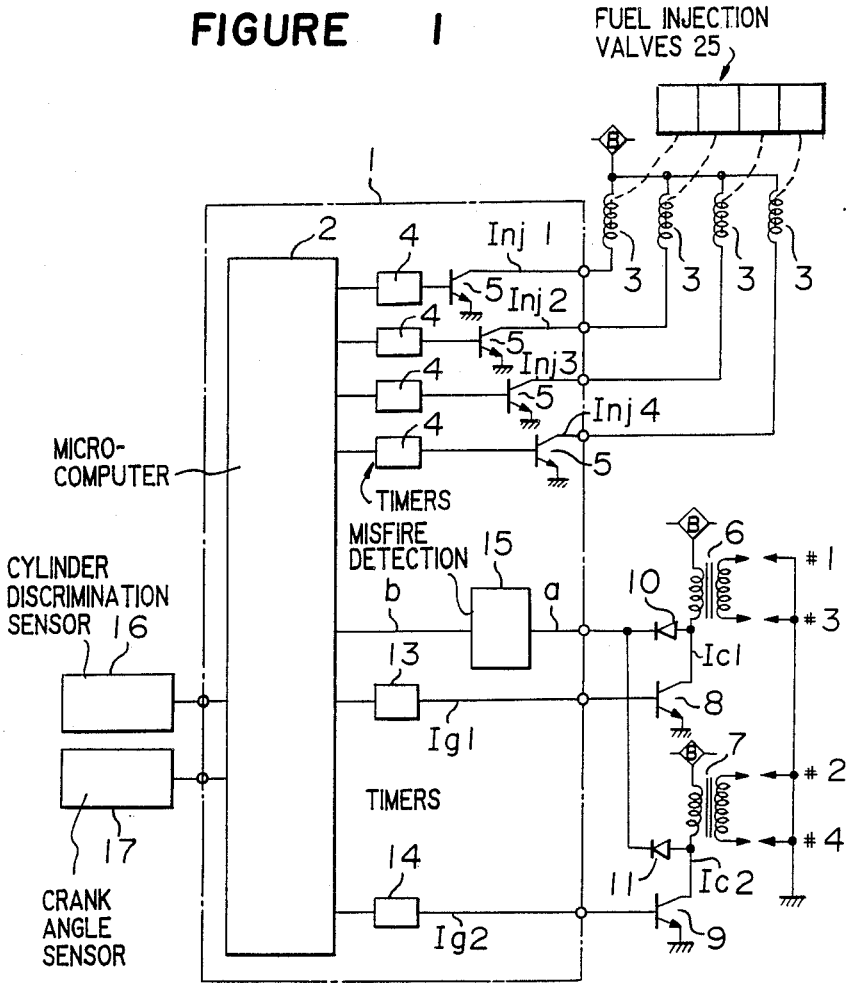
FIG. 1 is a schematic structural diagram showing the first embodiment of the engine control apparatus according to the present invention.

FIG. 1 illustrates a schematic construction of the engine control apparatus according to the first embodiment of the present invention, in which a reference numeral 1 designates an engine control section, a numeral 2 refers to a micro-computer, a numeral 3 denotes a fuel injection valve driving coil, connected to mechanically drive one of the fuel injection valves 25 which is provided for each cylinder, a numeral 4 refers to a timer connected to the micro-computer 2, a numeral 5 represents a transistor provided between the timer 4 and the driving coil 3, a numeral 6 refers to an ignition coil for the first and third cylinders, a reference numeral 7 denotes an ignition coil for the second and fourth cylinders, numerals 8 and 9 refer to transistors for driving the ignition coils 6 and 7, numerals 10 and 11 respectively refer to diodes connected to the primary side of the ignition coils 6 and 7, reference numerals 13 and 14 designate timers which are connected to the micro-computer 2 to impart ignition control signals $I_{g1}$ and $I_{g2}$ to the transistors 8 and 9, respectively, and a numeral 15 refers to a misfire detection means which is connected between the micro-computer 2 and the diodes 10, 11. This device detects the misfire of a cylinder due to the absence of an ignition signal. For this misfire detection means, there is used a device such as flip-flop which produces alternately an H signal and an L signal output based on a periodic signal, a, indicating the presence of ignition signals, introduced as an input into the misfire detection means. By the way, the primary windings of the ignition coils 6 and 7 are unified through the respective diodes 10 and 11 to constitute an OR circuit which, in turn, is connected to the misfire detection means.

There is further introduced as an input into the input terminal of the engine control section 1 an output from a cylinder discrimination sensor 16 which generates a cylinder discrimination signal for a particular cylinder as well as an output from a crank angle sensor 17 which generates a crank angle signal in synchronism with a predetermined crank angle position.

In the following, explanations will be made as to the operation of the above-described engine control apparatus in reference to FIGS. 2 and 3 of the accompanying drawing. The cylinder discrimination signal is generated for a particular cylinder, for example, the first cylinder, while the crank angle signal is outputted for each of the first and fourth cylinders with a pulse width of from BTDC 75° to BTDC 5°. The micro-computer 2 receives these signals and produces signals to drive the fuel injection valves at the appropriate time based on these signals. Then, fuel injection valve drive signals $I_{nj1}$ to $I_{nj4}$ are sequentially applied to each of the driving coils 3 through the timer 4 and the transistor 5, whereby the fuel injection is carried out. On the other hand, ignition control signals $I_{g1}$ and $I_{g2}$ are applied to the transistors 8 and 9 through the timers 13 and 14, respectively, to alternately generate the primary voltages $I_{c1}$ and $I_{c2}$ at the primary side of the ignition coils 6 and 7, whereby a high tension voltage is generated at the secondary side thereof to ignite sequentially those cylinders which are in the compression stroke. The primary voltages $I_{c1}$ and $I_{c2}$ are applied to the misfire detection means 15 (signal a) through the diode 10, and its output b is applied to the microcomputer 2.

When the control line carrying the ignition control signals $I_{g1}$ and $I_{g2}$ or the transistors 8 and 9 are not operating properly, the primary voltages $I_{cl}$ and $I_{c2}$ will not be generated and accordingly a misfire will be detected by the misfire detection means 15.

In the case of the ignition of the cylinders being carried out regularly, the output signal b from the misfire detection means 15 repeats its high level signal H and low level signal L at every ignition timing. Here, when wire breakage or other troubles take place in the ignition coil 7 for the second and fourth cylinders, the primary voltage $I_{c2}$ is no longer generated as shown by a dot line in FIG. 3, whereby no ignition is effected. In such case, there is no input signal a into the misfire detection means 15, and the output b does not reverse alternately, indicating that a cylinder has misfired. The micro-computer 2 detects the misfire and determines which cylinders are involved based on the cylinder discrimination signal, stops the drive control signals $I_{nj2}$ and $I_{nj4}$, and stops thereby the fuel injection into the second and fourth cylinders. On account of this, unburnt gas is prevented from being discharged outside. Also, if the output signal b from the ignition detection means, 15 becomes unchangeable due to the breakage of the signal line from the "OR" circuit formed by the diodes 10 and 11, or due to other causes, all of cylinders appear to be misfiring. In such case, the micro-computer 2 produces output signals $I_{nj1}$ to $I_{nj4}$ for the fuel injection as usual, thereby effecting fuel injection for all the cylinders, since the signal itself is probably in error. When all of the cylinders are actually misfiring, the engine will stop, from lack of a spark and, hence no trouble results even though the fuel injection continues.

Since the microcomputer 2 has a great many connections to the rest of the apparatus, there may be a shortage of terminals. Accordingly it is desirable to combine inputs so that there will be sufficient terminals for the device. Since the primary voltages $I_{c1}$ and $I_{c2}$ are connected together by the use of an OR circuit, composed of diodes 10 and 11, only one input terminal is needed for these inputs.

As described above, according to the first embodiment of the present invention, when any of the cylinders is misfired, this state is detected to stop the fuel injection into the misfired cylinder, whereby unburnt gas is prevented from burning in the exhaust pipe, hence shortening of the service life of the catalyst and occurrence of fire can be prevented. Further, owing to the misfired state detection signals for each of the cylinders being integrated into a single OR signal, it becomes possible to reduce the number of input terminal in the control means. Furthermore, since the misfire detection means has already detected the misfired cylinder by the primary voltage of the ignition coil, it is possible to detect without failure the misfire due to trouble in every part of the ignition system with the primary voltage.

Figure 4:
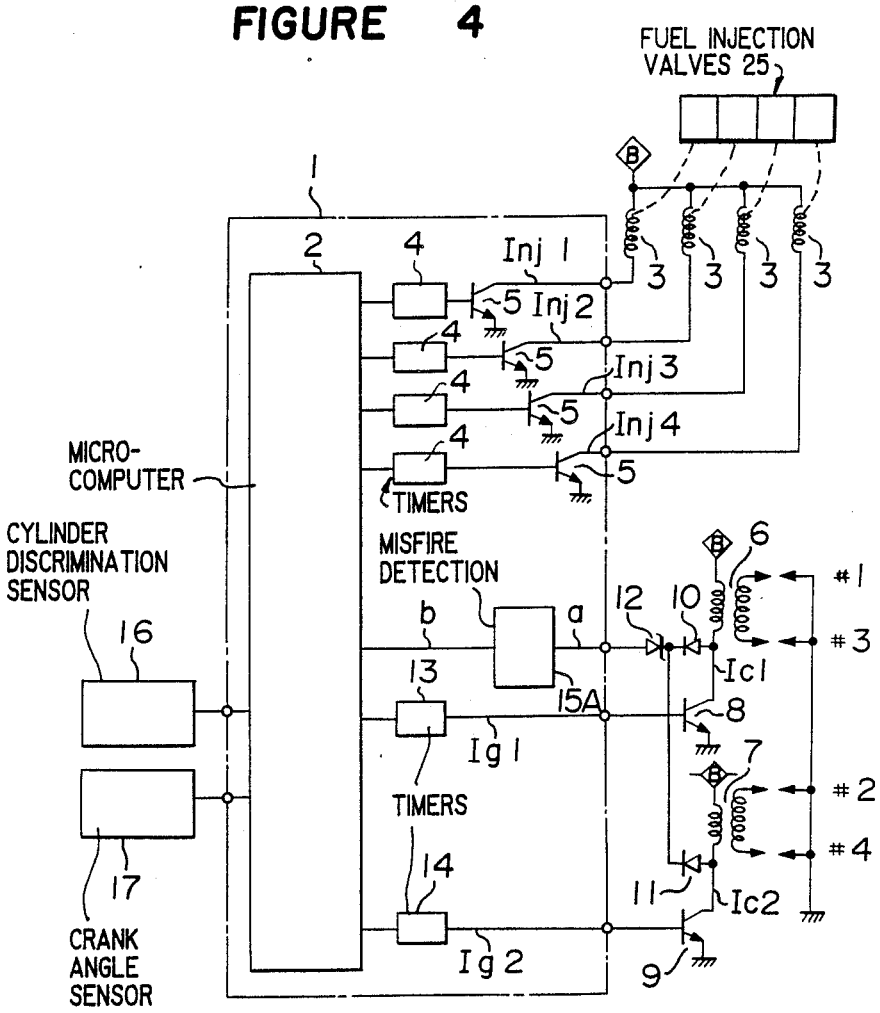
FIG. 4 is a schematic structural diagram showing the second embodiment of the engine control apparatus according to the present invention.

FIG. 4 illustrates the second embodiment of the engine control apparatus according to the present invention. In the drawing, the same or corresponding parts as those in FIG. 1 are designated by the same reference numerals and the explanations for them are dispensed with.

Referring to FIG. 4, a reference numeral 12 designates a Zener diode which is connected to the cathode side of the diodes 10 and 11, and is common to both of them, and a numeral 15A refers to misfire detection means connected between the micro-computer 2 and the Zener diode 12.

Figure 5:
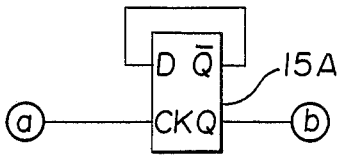
FIG. 5 shows a circuit diagram of the misfire detection means.

FIG. 5 shows a concrete construction of one example of the misfire detection means 15, in which a D-terminal and a $\overline{Q}$-terminal of a D flip-flop are mutually connected, the Q-output terminal producing alternately an H signal and an L signal at every rising of the clock signal.

Figure 2:
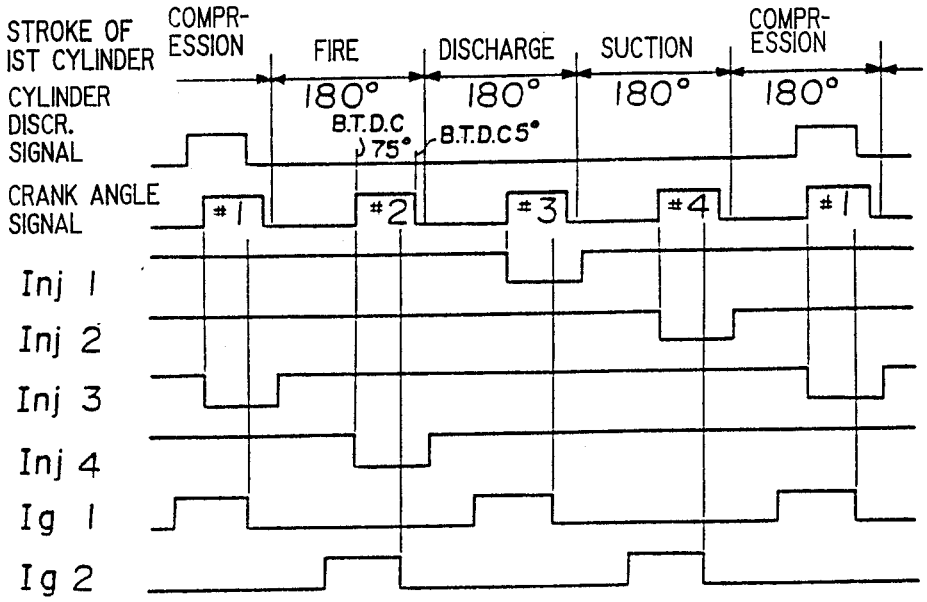
FIGS. 2 and 3 show respectively operating waveforms of important parts of the engine control apparatus according to the first embodiment of the present invention.
Figure 3:
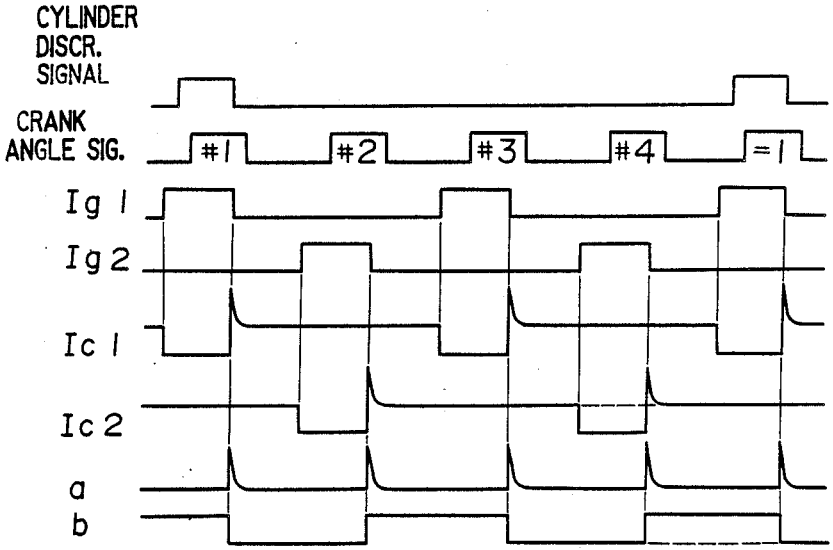
Figure 6:
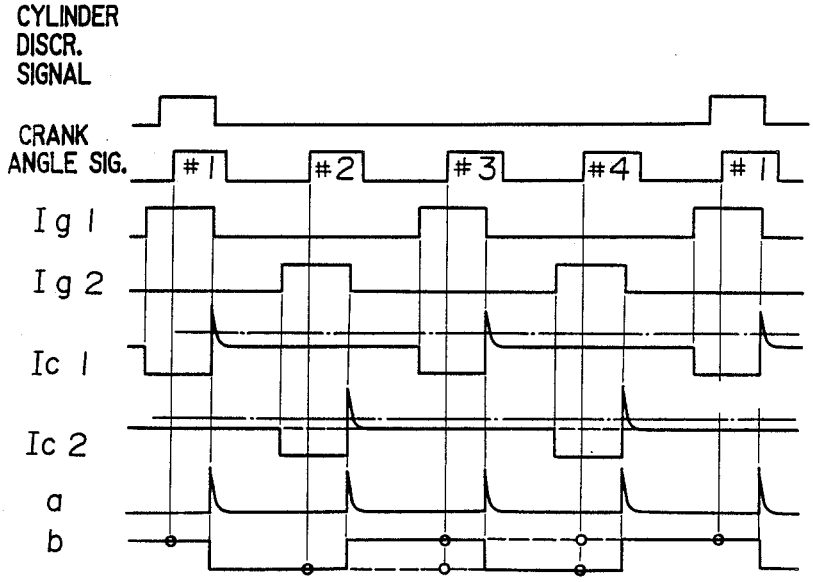
FIG. 6 shows operating waveforms of important parts of the engine control apparatus according to the second embodiment of the present invention.

The operation of the engine control apparatus according to this second embodiment are substantially same as those shown in FIGS. 2 and 3 which have been used for the explanation of the first embodiment. In this second embodiment, however, the primary voltage $I_{c1}$ and $I_{c2}$ are applied to the Zener diode 12 through the diodes 10 and 11, on account of which, when the voltages become higher than the Zener level, they are applied to the misfire detection means 15 (signal a), and the output b therefrom is applied to the micro-computer 2. The waveforms in this case are shown in FIG. 6.

Figure 7:
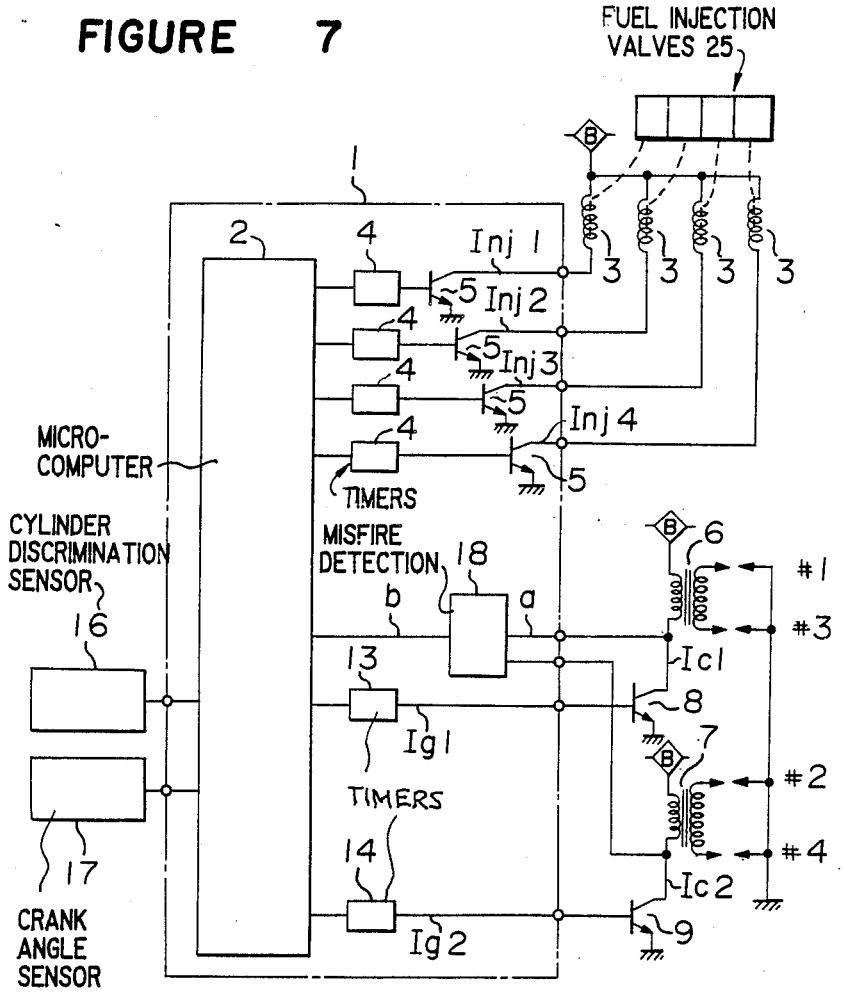
FIG. 7 is a schematic structural diagram showing the third embodiment of the engine control apparatus according to the present invention.
Figure 8:
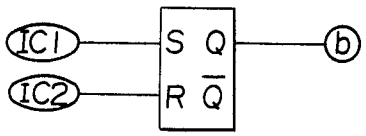
FIG. 8 is a circuit diagram of the misfire detection means.
Figure 9:
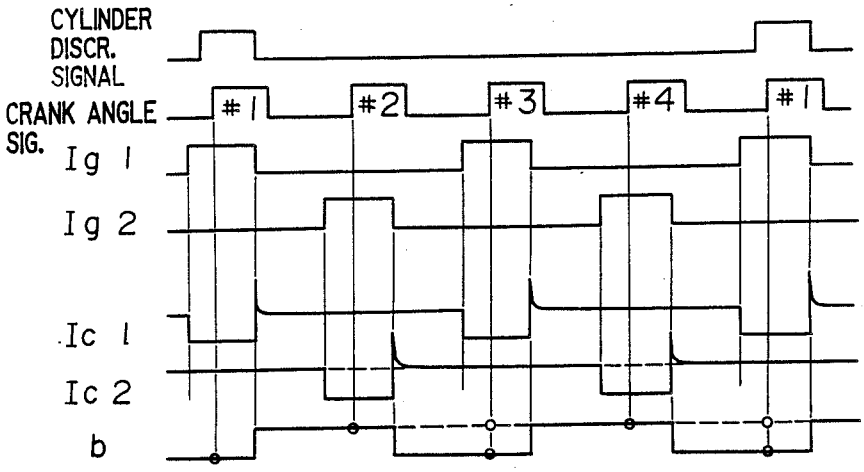
FIG. 9 shows operating waveforms of important parts of the engine control apparatus according to the third embodiment of the present invention.

FIGS. 7 and 9 illustrate the engine control apparatus according to the third embodiment of the present invention, wherein a numeral 18 refers to a misfire detection means with the input side thereof being connected to the primary side of the ignition coils 6 and 7. The misfire detection means 18 is constructed with an RS flip-flop as shown in FIG. 8, to which the primary voltages $I_{c1}$ and $I_{c2}$ coils 6 and 7 are introduced as inputs. The waveforms of the primary voltages $I_{c1}$ and $I_{c2}$ are the same as the one as shown in FIG. 3, in which when the set terminal of the misfire detection means 18 receives the voltage $I_{c1}$, its output b is risen, and when it has the voltage $I_{c2}$ introduced into its reset terminal, its output b is trailed. Accordingly, when the ignition is being performed regularly, the output b also assumes the high level and the low level alternately.

When the misfire takes place due to abnormality in the ignition coil 7 for the second and fourth cylinders, the output b remains at the level H, whereby it is able to detect the misfire.

As mentioned above, according to the second and third embodiments of the present invention, there can be obtained the same function and effect as those in the first embodiment. In particular, since the misfire detection means is constructed with the flip-flop, the overall construction of the engine control apparatus can be made simple.

In the second and third embodiments of the present invention as shown in FIGS. 4 to 9, there is illustrated an example of using a single flip-flop as the misfire detection means. It is, however, possible to construct the misfire detection means by use of a plurality of flip-flops as shown in FIG. 10.

Figure 10:
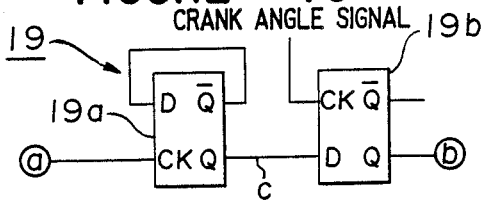
FIG. 10 shows a circuit diagram of the misfire detection means to be used in the fourth embodiment of the present invention.

The fourth embodiment according to the present invention is the same in construction as that shown in FIG. 1 with the exception that a flip-flop 19 of the construction as shown in FIG. 10 is used as the misfire detection means.

In FIG. 10, the misfire detection means 19 is constructed with a first D flip-flop 19*a* with its D-terminal and Q-terminal being connected each other and a second D flip-flop 19*b* with its Q-terminal being introduced as an input into the micro-computer 2.

Figure 11:
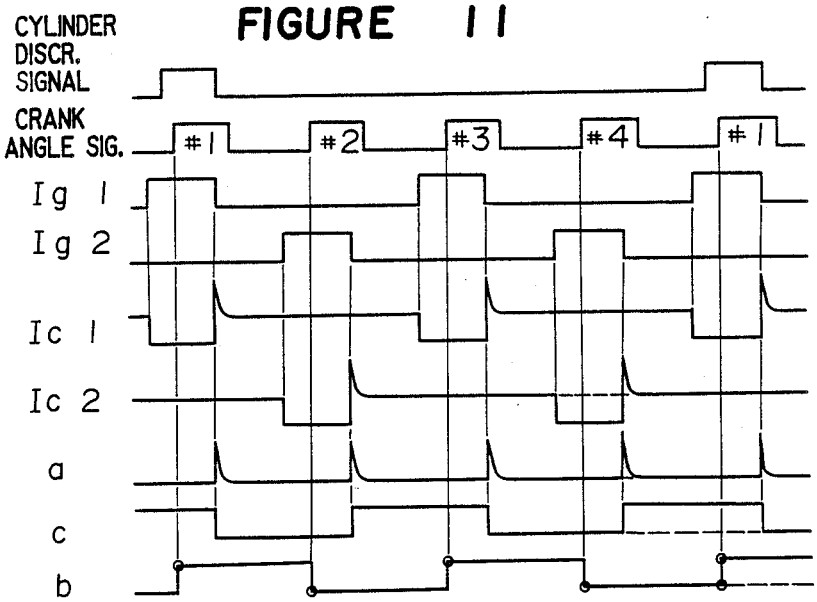
FIG. 11 shows the operating waveforms in important parts of the engine control apparatus according to the present invention.

In the following, explanations will be made as to the operations of the fourth embodiment of the engine control apparatus in reference to the above-described FIG. 3 as well as FIG. 11 which is peculiar to this embodiment.

If the ignition is being performed regularly, the first flip-flop 19*a* receives thereinto an input a due to the ignition timing, and the Q-output c repeats the levels H and L. This output c is introduced as an input into the D-terminal of the flip-flop 19*b*, the Q-output b of which is reversed at every rising of the crank angle signal. In this case, if wire breakage, etc. occurs in the ignition coil 7 for the second and fourth cylinders, the primary voltage $I_{c2}$ does not become generated as shown by the dot line in FIG. 4, hence no input a is introduced and the output c is substantially at an equal interval and does not become reversed alternately. On account of this, the output b becomes also same as the output c. This output b is read into the micro-computer 2, which detects the misfire in the second and fourth cylinders, stops the drive control signals $I_{nj2}$ and $I_{nj4}$, and stops thereby the fuel injection to the second and fourth cylinders. On account of this, the unburnt gas is prevented from being discharged outside.

Incidentally, the output c from the first flip-flop 19*a* is reversed at every ignition timing. This ignition timing (signal a) however shifts between BTDC 75° and BTDC 5°, and, owing to possible delay in the operation by the software, if the timing for reading the output is insufficient, it occurs from time to time that the micro-computer 2 makes misjudgement. In this embodiment, therefore, the second flip-flop 19*b* is further provided, whereby the output b becomes reversed in synchronism with the crank angle signal which is made constant by a hardware, hence there is no possibility of the micro-computer making misjudgement.

Thus, according to the fourth embodiment of the present invention, there can be obtained the same resulting effect as in the first embodiment, in addition to which, since the misfire detection means is constructed with the first flip-flop which is reversed in synchronism with the ignition timing and the second flip-flop which renews the output from the first flip-flop with the timing of the crank angle signal, there can be performed discrimination of the misfired cylinder with high reliability.

In the following, explanations will be made in reference to FIGS. 12 to 16 as to the fifth embodiment of the engine control apparatus according to the present invention. In the drawing, the reference numerals 1 to 11, 16 and 17 designate the same constituent parts as in the first embodiment, hence explanations for them are dispensed with.

Figure 12:
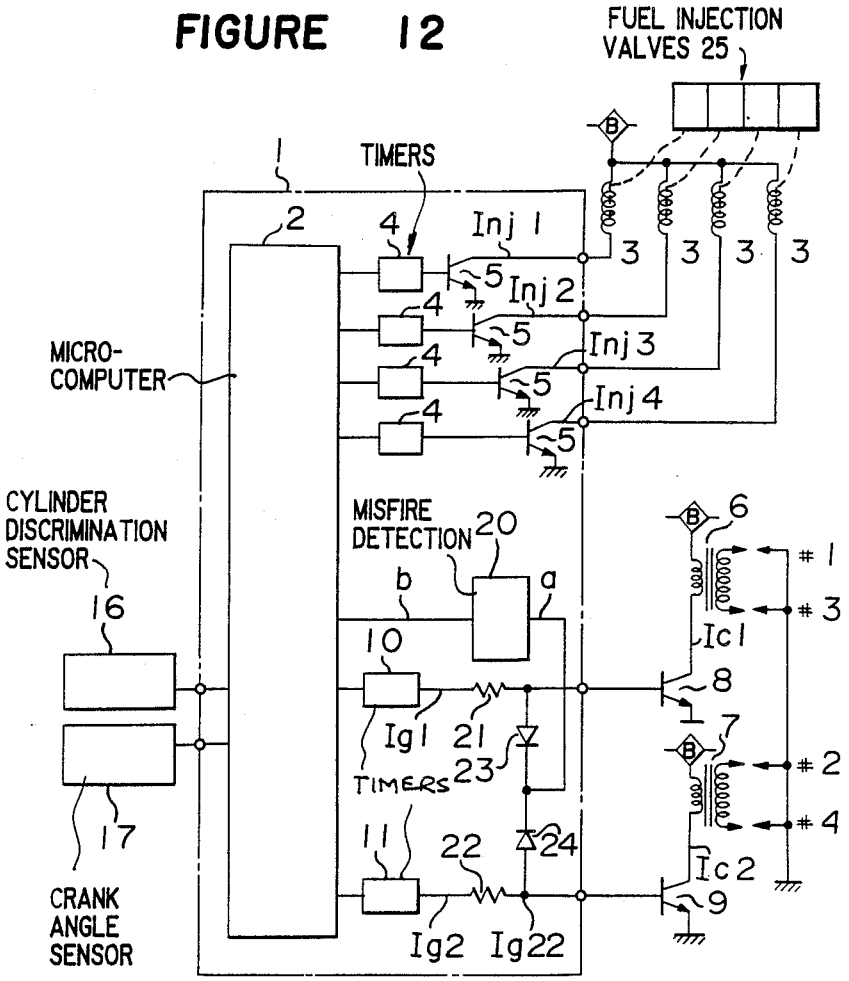
FIG. 12 is a schematic structural diagram of the fifth embodiment of the engine control apparatus according to the present invention.

Referring to FIG. 12, a numeral 20 refers to the misfire detection means which is provided in the engine control section 1, and into which ignition control signals $I_{g1}$ and $I_{g2}$ are introduced as inputs through resistors 21, 22 and diodes 23, 24. Also, there are introduced as inputs into the input terminal of the engine control section 1, the output from the cylinder discriminating sensor 16 which generates the cylinder discrimination signal for each of the particular cylinders and the output from the crank angle sensor 17 which generates the crank angle signal in synchronism with a predetermined crank angle position.

Figure 13:
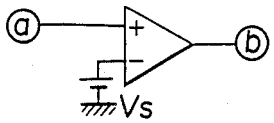
FIG. 13 is a circuit diagram of the misfire detection means.

FIG. 13 shows a concrete construction of the misfire detection means 20, which is made up of a comparator having a reference voltage $V_s$.

Figure 14:
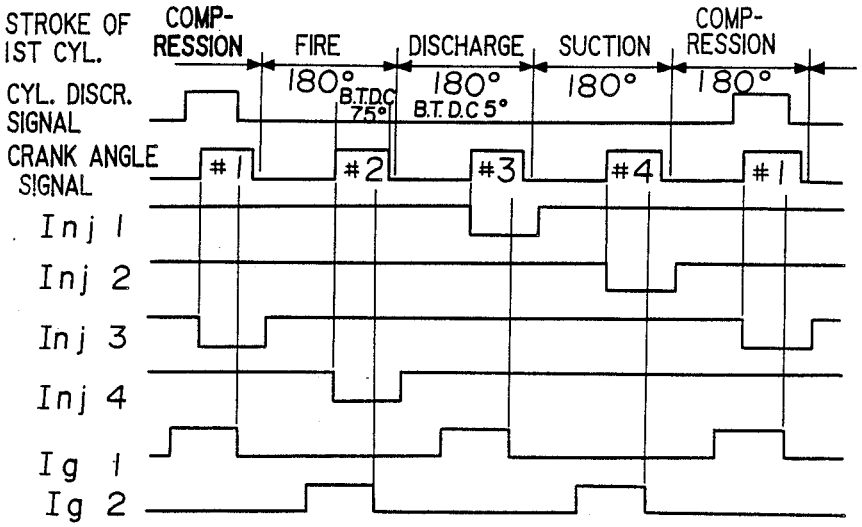
FIGS. 14 and 15 are respectively operating waveform diagrams in important parts of the engine control apparatus according to the fifth embodiment of the present invention.
Figure 15:
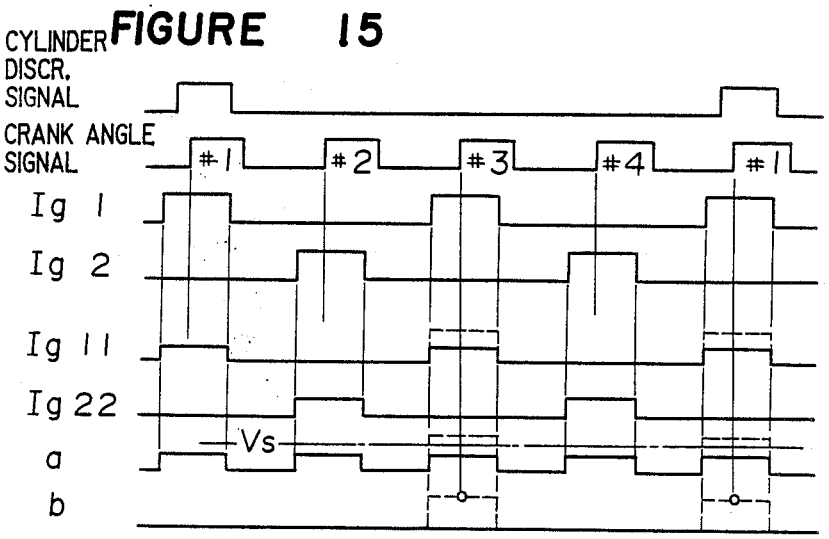

In the following, explanations will be given in reference to FIGS. 14 and 15 as to the operations of the above-described engine control apparatus. The cylinder discrimination signal is generated for a particular cylinder, for example, the first cylinder, while the crank angle signal is outputted for each of the first to fourth cylinders with a pulse width of from BTDC 75° to BTDC 5°. The micro-computer 2 operates the drive timing and the ignition timing of the fuel injection valve for each cylinder based on these signals. Then, fuel injection valve drive signals $I_{nj1}$ to $I_{nj4}$ are sequentially applied to each of the driving coils 3 through the timer 4 and the transistor 5, whereby the fuel injection is carried out. On the other hand, ignition control signals $I_{g1}$ and $I_{g2}$ are applied to the transistors 8 and 9 through the timers 10, 11 and the resistors 21, 22 respectively to alternately generate the primary voltages $I_{c1}$ and $I_{c2}$ at the primary side of the ignition coils 6 and 7, whereby a high tension voltage is generated at the secondary side thereof to ignite sequentially those cylinders which are in the compression stroke. Incidentally, the ignition control signals $I_{g1}$ and $I_{g2}$ are turned into signals $I_{11}$ and $I_{22}$ respectively through the resistors 21 and 22, and then are introduced as an input signal a into the ignition detection means 20 through the diodes 23 and 24 which constitute the OR circuit.

Now, if the ignition is being carried out regularly, the level of the signals $I_{g11}$ and $I_{g22}$ is relatively low even at its high level, because they are applied to the bases of the transistors 8 and 9, with the consequence that the input signal a does not measure up to the reference voltage $V_s$ and no output b is generated from the misfire detection means 20. Here, if there takes place wire breakage, etc. between the engine control section 1 and the transistor 8, the level of the signal $I_{g11}$ at its high level side becomes higher as shown by a dot line in FIG. 15, whereby the ignition operation is not performed. In this instance, the signal $I_{g11}$ becomes higher than the reference voltage $V_s$ and the ignition detection means 20 generates the output b, whereby the micro-computer 2 detects the misfire in the first and third cylinders, stops the drive control signals $I_{nj1}$ and $I_{nj3}$, and stops thereby the fuel injection into these first and third cylinders. As the consequence, unburnt gas is prevented from being exhausted outside.

Further, in spite of the fact that the engine control section 1 is apt to be short of its input and output terminals owing to complication of its controls, there is no necessity at all for increasing the input and output terminals, in this particular embodiment, owing to provision of the misfire detection means 20.

By the way, in the above-described first to fifth embodiments of the present invention, one ignition coil is provided for two cylinders, but it is of course possible to provide such ignition coil for each and every cylinder.

As described above, according to the fifth embodiment of the present invention, when any of the cylinder is misfired, this state is detected to stop the fuel injection into the misfired cylinder, whereby the unburnt gas is prevented from burning in the exhaust pipe, hence shortening of the service life of the catalyst and occurrence of fire can be prevented. Further, since the misfire detection means is provided in the engine control section, and the misfired cylinder is detected by the ignition control signal also generated in the engine control section, there is no need of increasing the number of the input and output terminals in the engine control section.

Although, in the foregoing, the present invention has been described with reference to several preferred embodiments thereof, it should be understood that these embodiments are illustrative only and not so restrictive, and that any changes and modifications may be made by those persons skilled in the art within the spirit and scope of the invention as recited in the appended claims.

What is claimed is:

1. An engine control apparatus which comprises, in combination:

a cylinder discrimination sensor for generating cylinder discriminating signal;

a crank angle sensor for generating crank angle signal;

a fuel injection valve provided in each cylinder of the engine;

a plurality of ignition coils with each and every cylinder being connected to one of said coils;

misfire detection means for detecting a state of misfire due to a lack of an ignition signal from any of said coils in accordance with signals received from said ignition coils, said misfire detection means producing a misfire detection signal which alternately changes between two levels in response to ignition signals during normal operation and which fails to change if a misfire is detected;

an engine control section for controlling said fuel injection valves and said ignition coils in correspondence to the detected misfire upon receipt of the cylinder discrimination signal and the crank angle signal, and for not actuating the fuel injection valve of the misfired cylinder in response to the cylinder discrimination signal upon receipt of the misfire detection signal; and an OR circuit connected to said ignition coils to detect a misfire state due to a lack of an ignition signal, said OR circuit having an output connected to an input of said misfire detection means.

2. An engine control apparatus according to claim 1, wherein said misfire detection means is at least one flip-flop.

3. An engine control apparatus according to claim 2, wherein said flip-flop is a D flip-flop with a D-terminal and a $\overline{Q}$-terminal thereof being connected with each other.

4. An engine control apparatus according to claim 2, wherein said flip-flop is a RS flip-flop.

5. An engine control apparatus according to claim 1, wherein said misfire detection means comprises a first flip-flop with an output which alternately shifts between two levels at each ignition signal and a second flip-flop which renews an output from said first flip-flop at every timing of the crank angle signal in normal operation.

6. An engine control apparatus according to claim 1, wherein said control section does actuate the fuel injection valve for all cylinders, when all of the cylinders have been detected as misfired.

7. An engine control apparatus according to claim 1, wherein said misfire detection means is connected through said OR circuit to the primary winding of said ignition coils and detects a state of misfire in accordance with the voltage of said primary windings.

8. An engine control apparatus which comprises, in combination:

a cylinder discrimination sensor for generating cylinder discrimination signal;

a crank angle sensor for generating crank angle signal;

a fuel injection valve provided in each cylinder of the engine;

a plurality of ignition coils with each and every cylinder being connected to one of said coils;

detection means which receives the cylinder discrimination signal and the crank angle signal, and which detects a state of misfire from any of said coils based on the presence of an ignition control signal of said ignition coil to produce a misfire detection signal which alternately changes between two levels in response to each ignition signal during normal operation and which fails to change if a misfire is detected;

an engine control section which stops operation of said fuel injection valves of any misfired cylinders in response to the generation of a cylinder discrimination signal upon presence of said misfire detection signal; and an OR circuit connected to said ignition coils to detect a misfire state due to a lack of an ignition signal, said OR circuit having an output connected to an input of said detection means.

9. An engine control apparatus according to claim 8, wherein said misfire detection means is a comparator.

* * * * *